US011383896B2

(12) United States Patent
Oliveira

(10) Patent No.: US 11,383,896 B2
(45) Date of Patent: Jul. 12, 2022

(54) COVER FOR A CONTAINER

(71) Applicant: Graphic Packaging International, LLC, Atlanta, GA (US)

(72) Inventor: Steven M. Oliveira, Canton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 188 days.

(21) Appl. No.: 16/111,633

(22) Filed: Aug. 24, 2018

(65) Prior Publication Data

US 2019/0062008 A1 Feb. 28, 2019

Related U.S. Application Data

(60) Provisional application No. 62/551,967, filed on Aug. 30, 2017.

(51) Int. Cl.
*B65D 43/06* (2006.01)
*B65D 43/08* (2006.01)
(Continued)

(52) U.S. Cl.
CPC ..... *B65D 43/06* (2013.01); *B65D 5/64* (2013.01); *B65D 15/24* (2013.01); *B65D 25/54* (2013.01);
(Continued)

(58) Field of Classification Search
CPC .... B65D 43/06; B65D 43/02; B65D 43/0202; B65D 43/00; B65D 43/08; B65D 43/12; B65D 5/64; B65D 5/68; B65D 5/685; B65D 5/4204; B65D 5/4208; B65D 5/46; B65D 5/46072; B65D 15/24; B65D 25/2882; B65D 25/2888; B65D 25/2894;
(Continued)

(56) References Cited

U.S. PATENT DOCUMENTS 1,335,296 A 3/1920 Postal et al.
D65,395 S 8/1924 Connor
(Continued)

FOREIGN PATENT DOCUMENTS

BE 904404 6/1986
DE 103 04 527 8/2004
(Continued)

OTHER PUBLICATIONS

International Search Report and Written Opinion for PCT/US2018/047884 dated Dec. 7, 2018.
(Continued)

*Primary Examiner* — Robert Poon
(74) *Attorney, Agent, or Firm* — Womble Bond Dickinson (US) LLP

(57) ABSTRACT

A cover for a container includes a plurality of panels extending at least partially around an interior of the cover. The plurality of panels includes a central panel, at least one side panel foldably connected to the central panel, and at least one end panel foldably connected to the central panel. At least one of the at least one side panel and the at least one end panel includes an opening configured to receive a portion of the container. The opening includes an engagement edge for engaging the container. The cover also includes a handle foldably connected to the central panel.

30 Claims, 8 Drawing Sheets

(51) Int. Cl.

| | |
|---|---|
| ***B65D 43/02*** | (2006.01) |
| ***B65D 8/00*** | (2006.01) |
| ***B65D 25/54*** | (2006.01) |
| ***B65D 5/64*** | (2006.01) |
| ***B65D 51/24*** | (2006.01) |

(52) U.S. Cl.

CPC ..... *B65D 43/0202* (2013.01); *B65D 43/0218* (2013.01); *B65D 43/08* (2013.01); *B65D 51/242* (2013.01); *B65D 2543/00101* (2013.01); *B65D 2543/00194* (2013.01); *B65D 2543/00212* (2013.01); *B65D 2543/00231* (2013.01); *B65D 2543/00268* (2013.01); *B65D 2543/00296* (2013.01); *B65D 2543/00314* (2013.01); *B65D 2543/00361* (2013.01); *B65D 2543/00481* (2013.01); *B65D 2543/00537* (2013.01); *B65D 2543/00546* (2013.01); *B65D 2543/00555* (2013.01); *B65D 2543/00574* (2013.01); *B65D 2543/00842* (2013.01)

(58) Field of Classification Search

CPC ..... B65D 71/0003; B65D 71/406; B65D 51/242; B65D 2543/00101; B65D 2543/00194; B65D 2543/00212; B65D 5/16; B65D 5/20; B65D 5/4295; B65D 5/4608; B65D 5/2047; B65D 5/667; B65D 71/0029; B65D 71/0055; B65D 71/0037; B65D 2571/00283; B65D 21/0234; B65D 88/025

USPC ... 220/260, 212.5, 752, 761, 763, 771, 4.21, 220/4.27, 4.24; 229/103, 117.09, 117.11, 229/117.23, 117.24, 117.13, 117.16; 206/200

See application file for complete search history.

(56) References Cited

U.S. PATENT DOCUMENTS

| | | | | |
|---|---|---|---|---|
| D80,092 | S | 12/1929 | Schleicher | |
| D101,850 | S | 11/1936 | Bowen | |
| 2,091,664 | A | 8/1937 | Walsh | |
| 2,252,147 | A * | 8/1941 | Warren | B65D 5/5246 206/768 |
| 2,819,008 | A * | 1/1958 | White | B65D 5/4295 229/114 |
| 2,823,063 | A | 2/1958 | Toensmeier | |
| 2,844,245 | A | 7/1958 | Gruber et al. | |
| 2,919,844 | A | 1/1960 | Anderson, Jr. | |
| 3,016,259 | A | 1/1962 | Lawrence | |
| 3,075,799 | A | 1/1963 | Weiss | |
| 3,123,213 | A | 3/1964 | Kulig | |
| 3,151,802 | A | 10/1964 | Spery | |
| 3,245,711 | A | 4/1966 | Dantoin | |
| 3,414,313 | A | 12/1968 | Schwarz | |
| D220,169 | S | 3/1971 | Lundberg | |
| 3,616,897 | A | 11/1971 | Vrana | |
| 3,661,417 | A | 5/1972 | Inman | |
| 3,675,764 | A | 7/1972 | Dutcher | |
| 3,701,416 | A | 10/1972 | Lawrence | |
| 3,756,394 | A | 9/1973 | Huault | |
| D241,820 | S | 10/1976 | Jewell | |
| 4,127,228 | A * | 11/1978 | Hall | B65D 5/2047 229/117.16 |
| 4,139,094 | A | 2/1979 | Berry et al. | |
| 4,192,540 | A | 3/1980 | Oliff | |
| 4,272,010 | A | 6/1981 | Capo | |
| D261,235 | S | 10/1981 | McMullan | |
| 4,336,898 | A | 6/1982 | Joyce | |
| D271,944 | S | 12/1983 | Wood | |
| 4,449,744 | A | 5/1984 | Vossen | |
| 4,621,734 | A | 11/1986 | Heijnen et al. | |
| 4,717,070 | A * | 1/1988 | Taub | B65D 5/685 229/117.16 |
| 4,768,703 | A | 9/1988 | Sosler et al. | |
| 5,058,735 | A | 10/1991 | Bienaime | |
| D321,456 | S | 11/1991 | Wolff | |
| D322,571 | S | 12/1991 | Groves | |
| 5,103,971 | A | 4/1992 | Schuster | |
| 5,135,104 | A | 8/1992 | Jorba | |
| 5,163,548 | A | 11/1992 | Domansky | |
| D334,498 | S | 4/1993 | Romme | |
| 5,201,412 | A | 4/1993 | Schuster et al. | |
| D340,411 | S | 10/1993 | Ong | |
| 5,351,815 | A | 10/1994 | Fogle et al. | |
| 5,355,999 | A | 10/1994 | Sutherland | |
| 5,364,333 | A | 11/1994 | Gulliver et al. | |
| 5,415,278 | A | 5/1995 | Sutherland | |
| 5,704,470 | A | 1/1998 | Sutherland | |
| D394,385 | S | 5/1998 | Laughlin | |
| 5,779,048 | A * | 7/1998 | Dunn | B65D 5/326 206/449 |
| D408,282 | S | 4/1999 | McCann | |
| 5,921,392 | A | 7/1999 | Davis | |
| 6,092,719 | A * | 7/2000 | Capo | B65D 5/2047 229/114 |
| D434,256 | S | 11/2000 | Shimbo | |
| 6,223,892 | B1 | 5/2001 | Bakx | |
| 6,223,980 | B1 * | 5/2001 | Guillin | B65D 5/64 220/4.21 |
| 6,378,697 | B1 | 4/2002 | Sutherland et al. | |
| 6,422,453 | B1 | 7/2002 | Wang | |
| 6,488,322 | B2 | 12/2002 | Bakx | |
| D470,412 | S | 2/2003 | Palmer-Ball | |
| 6,869,009 | B2 | 3/2005 | Sutherland et al. | |
| D525,866 | S | 8/2006 | Oliveira | |
| D532,690 | S | 11/2006 | Oliveira | |
| 7,617,969 | B2 | 11/2009 | Oliveira | |
| D608,637 | S | 1/2010 | Getsy | |
| 7,703,665 | B2 | 4/2010 | McGowan | |
| 7,766,181 | B2 | 8/2010 | Fogle et al. | |
| 7,793,821 | B2 | 9/2010 | Oliveira | |
| 8,002,171 | B2 | 8/2011 | Ryan et al. | |
| 8,162,135 | B2 | 4/2012 | Oliveira | |
| D659,551 | S | 5/2012 | Ramirez | |
| 8,225,985 | B2 | 7/2012 | Oliveira | |
| D678,761 | S | 3/2013 | Cooper | |
| D693,217 | S | 11/2013 | Sill | |
| D758,191 | S | 6/2016 | Tu | |
| 9,598,202 | B2 | 3/2017 | Oliveira et al. | |
| D787,929 | S | 5/2017 | Sill | |
| D787,933 | S | 5/2017 | Sill | |
| 2006/0037882 | A1 * | 2/2006 | Appelbaum | B65D 43/0204 206/471 |
| 2012/0285854 | A1 | 11/2012 | Spivey, Sr. | |
| 2013/0306510 | A1 * | 11/2013 | Scott | B65D 5/4237 206/459.5 |
| 2016/0107789 | A1 * | 4/2016 | Itano | B65D 5/32 206/386 |
| 2019/0315512 | A1 * | 10/2019 | Smith | B65D 5/2038 |

FOREIGN PATENT DOCUMENTS

| | | |
|---|---|---|
| EP | 0 108 614 | 1/1987 |
| EP | 0 406 556 | 1/1991 |
| JP | 2008-074485 A | 4/2008 |
| KR | 10-0589832 B1 | 6/2006 |
| KR | 10-2009-0075572 A | 7/2009 |
| KR | 10-2009-0086316 A | 8/2009 |
| WO | WO 93/14993 | 8/1993 |
| WO | WO 02/059011 | 8/2002 |

OTHER PUBLICATIONS

Mr. Takeout Bags. To Go Containers. Nov. 1, 2017 [earliest online date], [site visited Jun. 20, 2018]. Available from internet, <URL:https://www.mrtakeoutbags.com/store/boxes-containers.html.> (Year: 2017).

* cited by examiner

COVER FOR A CONTAINER

CROSS-REFERENCE TO RELATED APPLICATION

This application claims the benefit of U.S. Provisional Patent Application No. 62/551,967, filed on Aug. 30, 2017.

INCORPORATION BY REFERENCE

The disclosure of U.S. Provisional Patent Application No. 62/551,967, which was filed on Aug. 30, 2017, is hereby incorporated by reference for all purposes as if presented herein in its entirety.

BACKGROUND OF THE DISCLOSURE

The present disclosure generally relates to a cover for at least partially overlying a container. In embodiments, the present disclosure relates to a cover that engages a container and has a handle for carrying the container together with the cover.

SUMMARY OF THE DISCLOSURE

According to one aspect of the disclosure, a cover for a container comprises a plurality of panels extending at least partially around an interior of the cover. The plurality of panels comprises a central panel, at least one side panel foldably connected to the central panel, and at least one end panel foldably connected to the central panel. At least one of the at least one side panel and the at least one end panel comprises an opening configured to receive a portion of the container. The opening comprises an engagement edge for engaging the container. A handle is foldably connected to the central panel.

According to another aspect of the disclosure, a blank for forming a cover for a container comprise a plurality of panels for extending at least partially around an interior of the cover formed from the blank. The plurality of panels comprises a central panel, at least one side panel foldably connected to the central panel, and at least one end panel foldably connected to the central panel. At least one of the at least one side panel and the at least one end panel comprises an opening configured to receive a portion of the container. The opening comprises an engagement edge for engaging the container. At least one handle flap is foldably connected to the central panel.

According to another aspect of the disclosure, a method of forming a cover for a container comprises obtaining a blank comprising a plurality of panels. The plurality of panels comprises a central panel, at least one side panel foldably connected to the central panel, and at least one end panel foldably connected to the central panel, and at least one handle flap foldably connected to the central panel. At least one of the at least one side panel and the at least one end panel comprises an opening that comprises an engagement edge. The method further comprises folding the plurality of panels at least partially around an interior of the cover. The method further comprises engaging the cover with the container.

According to another aspect of the disclosure, a package comprises a cover engaged with a container. The cover comprises a plurality of panels extending at least partially around an interior of the cover. The plurality of panels comprises a central panel, at least one side panel foldably connected to the central panel, and at least one end panel foldably connected to the central panel. At least one of the at least one side panel and the at least one end panel comprises an opening comprising an engagement edge for engaging the container. A handle is foldably connected to the central panel.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

A carrier or cover according to the present disclosure can accommodate containers of numerous different shapes. In this specification, the terms "lower," "bottom," "upper," "top," "front," and "back" indicate orientations determined in relation to fully erected covers or carriers.

As described herein, a carrier or cover may be formed by multiple overlapping panels, end flaps, and/or other portions. Such panels, end flaps, and/or other portions may be designated in relative terms to one another, e.g., "first", "second", "third", etc., in sequential or non-sequential reference, without departing from the disclosure.

Figure 1:
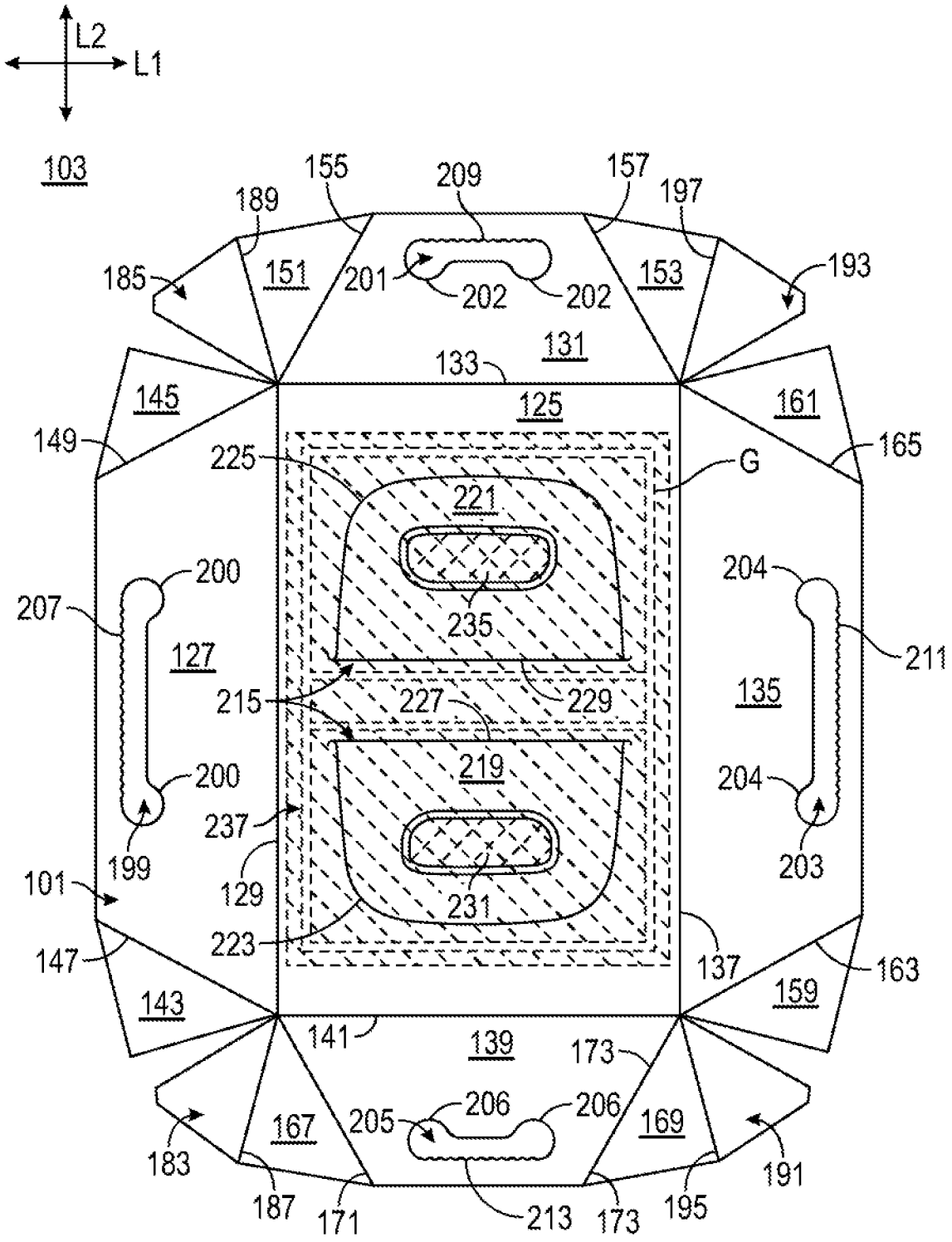
FIG. 1 is a plan view of an outer surface of a blank for forming a cover according to a first exemplary embodiment of the disclosure.
Figure 4:
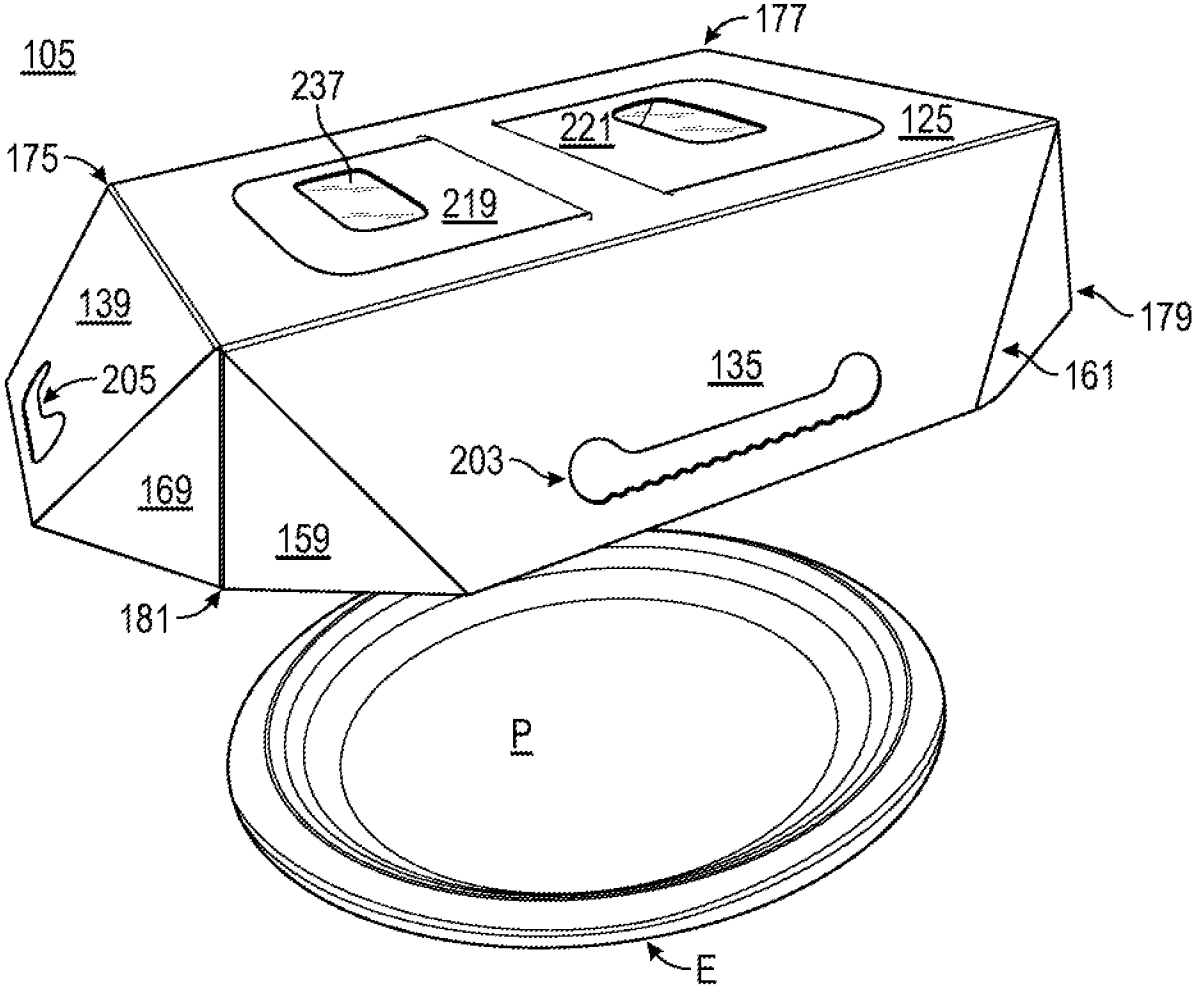
FIG. 4 is a perspective view of the cover of FIG. 2 provided with a container.
Figure 5:
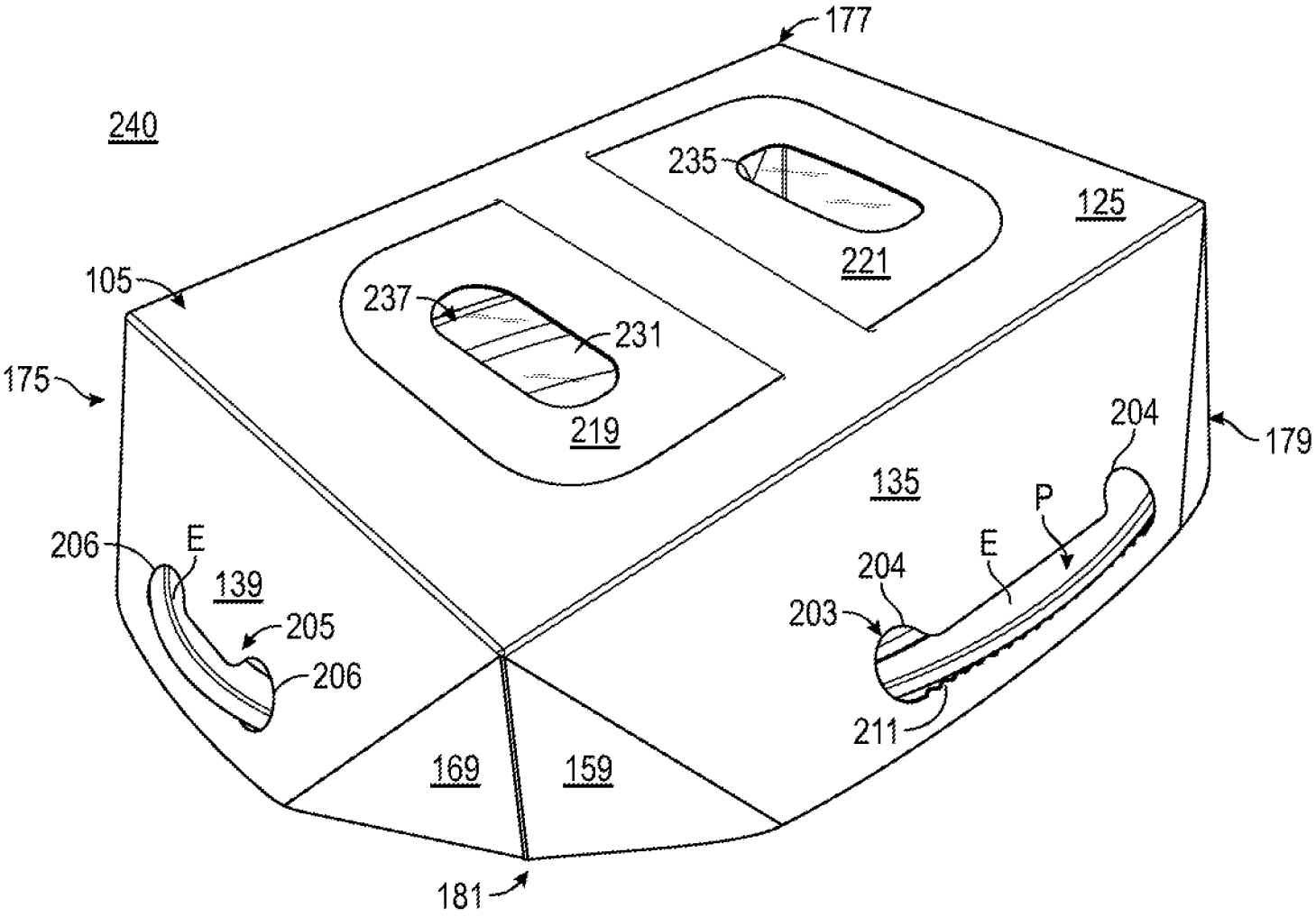
FIG. 5 is a perspective view of a package including the cover engaged with the plate of FIG. 4 according to the first exemplary embodiment of the disclosure.

FIG. 1 shows a plan view of an exterior side 101 of a blank 103 used to form a carrier or cover 105 (FIG. 2) in accordance with a first exemplary embodiment of the disclosure. As shown in FIG. 4, the cover 105 is configured to at least partially overlie a container such as a container P positioned beneath the cover 105 such that the cover 105 provides an at least partial enclosure for the container 5. The container P can have the form of, for example, a plate, a tray, a bowl, a box, a mat, or a cup, or any other construct for holding an article such as a food or beverage item. It will be understood that the container P can store a food or beverage item in an interior thereof and/or can support a food a beverage item on one or more surfaces thereof. The container P can be any suitable shape (e.g., oval, circular, square, rectangular, etc.) without departing from the disclosure. As shown in FIG. 5, the cover 105 is configured to engage, e.g., grip, interengage, and/or interlock, one or more portions of the container P such that the container P can be lifted and/or carried by a user via the cover 105. As shown in FIG. 5, a package 240 can be formed that includes the cover 105 coupled to the container P.

As shown in FIG. 1, the blank 103 has a longitudinal axis L1 and a lateral axis L2. The illustrated blank 103 includes a top or central panel 125, a first side panel 127 foldably connected to the central panel 125 at a longitudinal fold line 129, a first end panel 139 foldably connected to the central panel 125 at a lateral fold line 141, a second side panel 135 foldably connected to the central panel 125 at a longitudinal fold line 137, and a second end panel 131 foldably connected to the central panel 125 at a lateral fold line 133.

In the illustrated embodiment, a first corner flap 143 and a third corner flap 145 are foldably connected to the first side panel 127 at respective oblique fold lines 147, 149, a fourth corner flap 151 and a sixth corner flap 153 are foldably connected to the second end panel 131 at respective oblique fold lines 155, 157, a seventh corner flap 159 and a fifth corner flap 161 are foldably connected to the second side panel 135 at respective oblique fold lines 163, 165, and a second corner flap 167 and an eighth corner flap 169 are foldably connected to the first end panel 139 at respective oblique fold lines 171, 173. As shown, each of the corner flaps 143, 145, 151, 153, 159, 161, 167, 169 are obliquely disposed with respect to a respective panel 127, 131, 135, 139, e.g., each corner flap 143, 145, 151, 153, 159, 161, 167, 169 has an outer edge that is oblique relative to an outer edge of a respective panel 127, 131, 135, 139, such that upon folding of the blank 103 into the cover 105 (FIG. 2), the corner flaps 143, 145, 151, 153, 159, 161, 167, 169 form a first corner 175, a second corner 177, a third corner 179, and a fourth corner 181 that each conform to corners and/or curved portions of the container P.

As also shown, attachment flaps 183, 185 are foldably connected to the respective corner flaps 167, 165 at respective oblique fold lines 187, 189 and attachment flaps 191, 193 are foldably connected to the respective corner flaps 169, 153 at respective oblique fold lines 195, 197. Each respective attachment flap 183, 185, 191, 193, as shown, is spaced apart from a respective adjacent corner flap 167, 151, 169, 153.

Still referring to FIG. 1, each of the first side panel 127, the second side panel 135, the first end panel 139, and the second end panel 131 each includes a respective first opening 199, second opening 203, third opening 205, and fourth opening 201, each having a generally elongate configuration with a respective major axis extending in parallel with the respective fold lines 129, 137, 141, 133. Each opening 199, 201, 203, 205 includes a respective engagement edge 207, 209, 211, 213 formed along a lower portion thereof, e.g., along an edge closest to the outer edge of the respective panels 127, 131, 135, 139. As shown, each engagement edge 207, 209, 211, 213 is a frictionally-enhanced surface including one or more surfaces that protrude into the respective openings 199, 201, 203, 205. The engagement edges 207, 209, 211, 213 can have the form of a wave rule edge, as shown, comprising a series of pointed or rounded peaks joined by curved portions. In one embodiment, one or more of the engagement edges 207, 290, 211, 213 can have the form of a sawtooth edge or an otherwise textured edge to name a few. As described herein, upon formation of the cover 105 (FIG. 2), each opening 199, 201, 203, 205 is configured to receive a portion of the container P (FIG. 5) therethrough and engage the container P, e.g., via engagement edges 207, 209, 211, 213, such that the cover 105 and the container P are interlocked. In one embodiment, each opening 199, 201, 203, 205 can also include respective enlarged ends 200, 202, 204, 206 (FIGS. 2 and 3) for receiving portions of the container P therethrough and enhancing the interlocking engagement of the cover 105 and the container P. One or more of the enlarged ends 200, 202, 204, 206 can have a generally circular configuration, or can have a different configuration, such as ovoid, rectangular, or a different polygonal shape, without departing from the disclosure.

Figure 7:
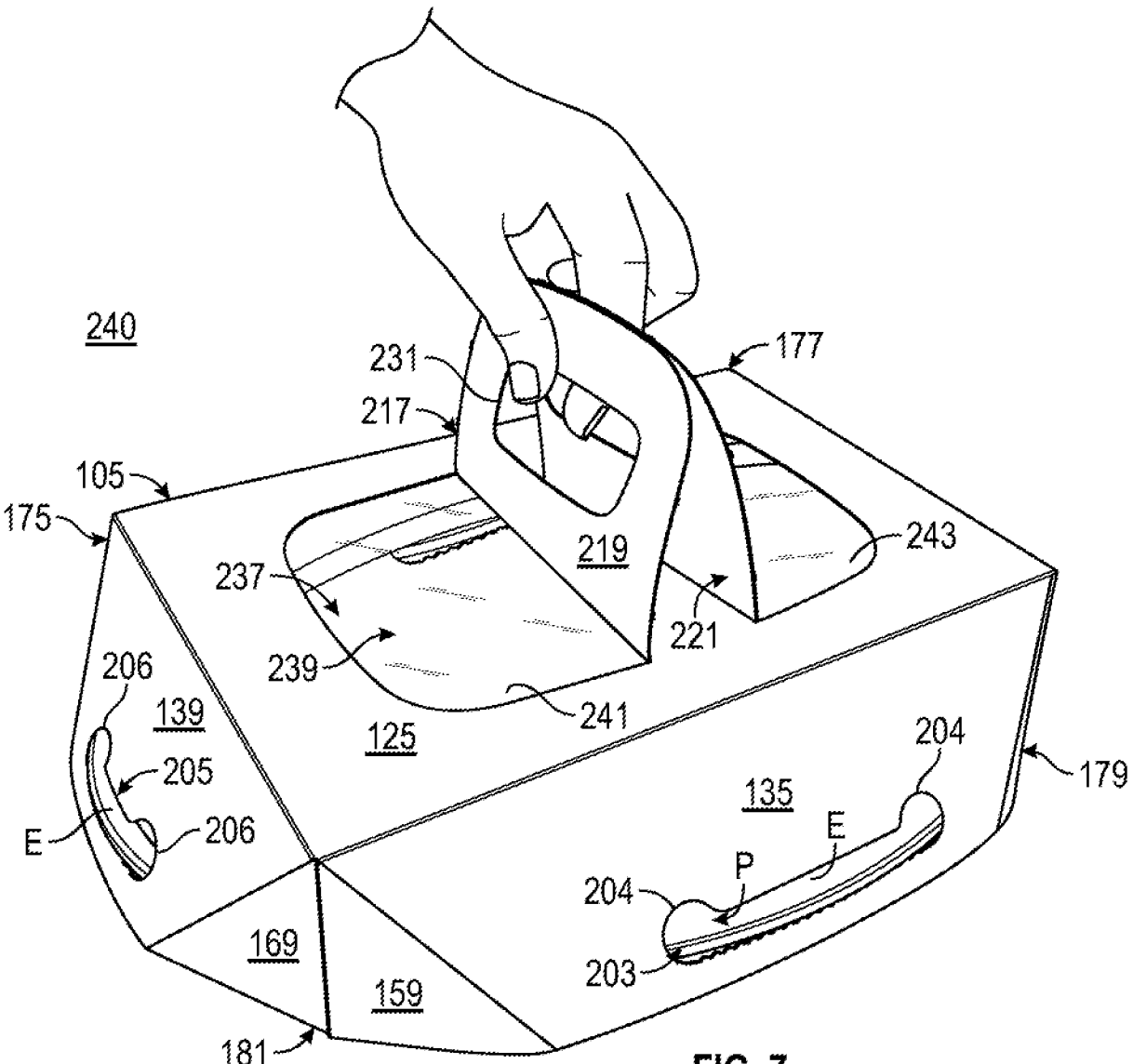
FIG. 7 is a second sequential perspective view of the package of FIG. 5 in use.

As shown, the central panel 125 includes handle features 215 for forming a handle 217 (FIG. 7) of the cover 105. The handle features 215 include a first handle flap 219 and a second handle flap 221 at least partially defined along respective tear lines 223, 225 and foldably connected to the central panel 125 at respective lateral fold lines 227, 229. The tear lines 223 225 extend between endpoints of the respective fold lines 227, 229, and can include one or more curved or angled portions. Each handle flap 219, 221, as shown, includes a respective opening 231, 235, for example, for receiving a portion of a user's hand or a tool or other structure.

Still referring to FIG. 1, a film 237 (shown in phantom view) can be provided in at least partial face-to-face contact with the central panel 125 such that the film 237 at least partially overlaps the handle features 215 along an interior surface of the blank 103. In this regard, the film 237 can be adhered to the central panel 125 of the blank 103 with one or more adhesives, such as glue. The film 237 can be comprised of a polymeric material, for example, cellophane or plastic, or another suitable material. As described herein, the film 237 can provide a viewing surface through a portion of the cover 105 and/or can seal the central panel 125 to maintain the freshness of items, e.g., food items, stored in or on the container P below the cover 105 (FIG. 4).

Figure 2:
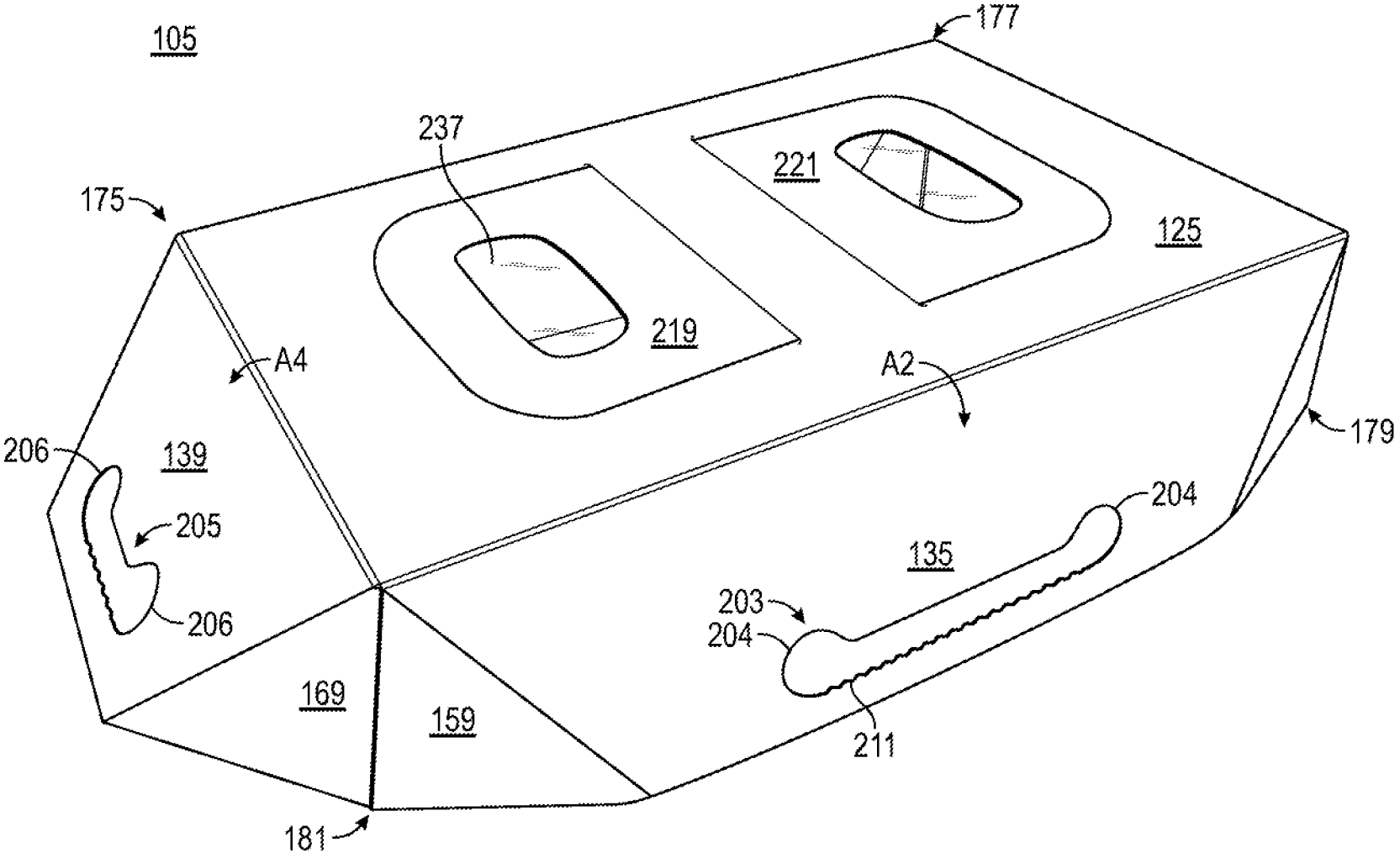
FIG. 2 is a perspective view of a cover formed from the blank of FIG. 1 according to the first exemplary embodiment of the disclosure.
Figure 3:
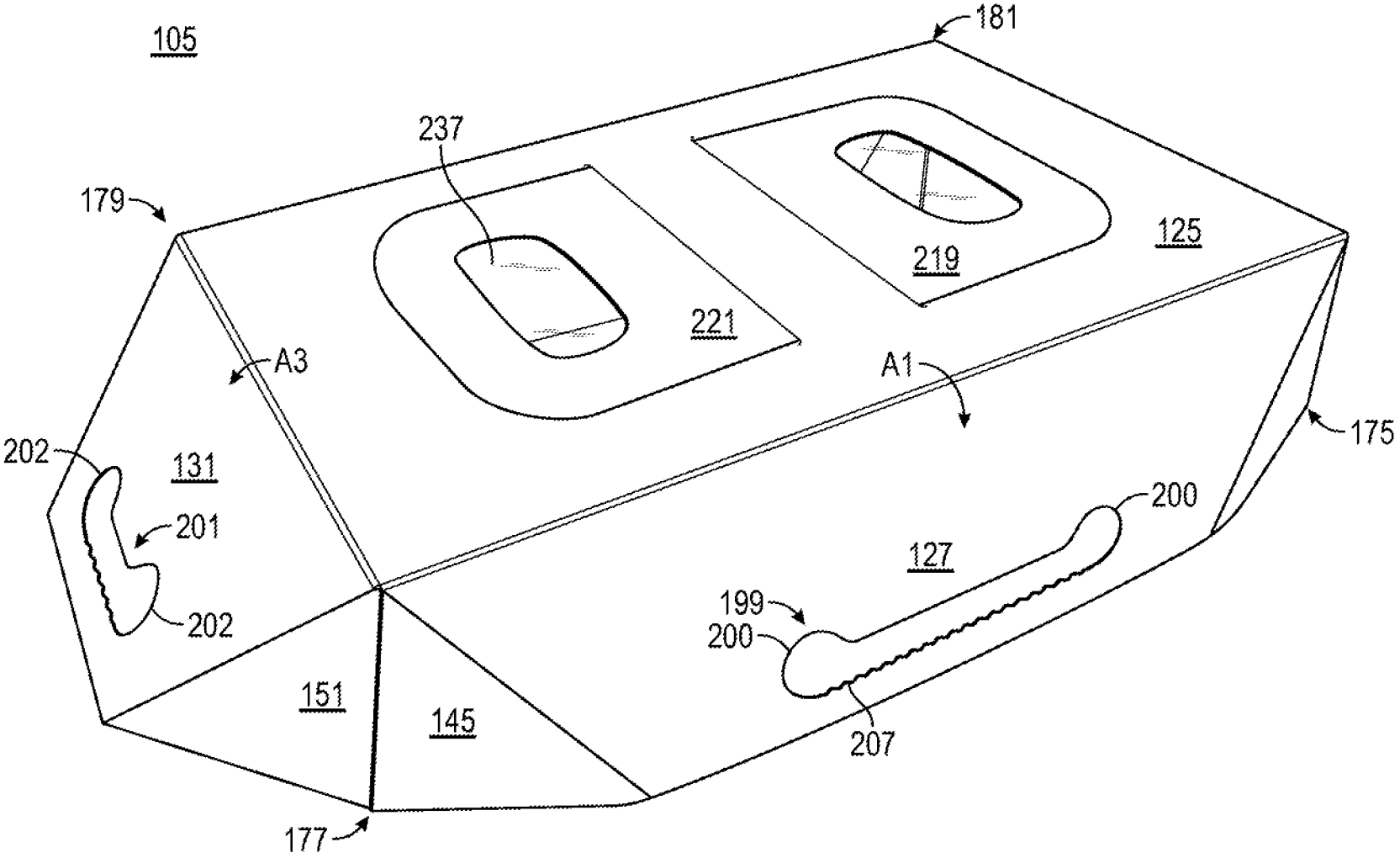
FIG. 3 is another perspective view of the cover of FIG. 2.

Referring additionally to FIGS. 2 and 3, the cover 105 can be formed from the blank 103 by folding the side panels 127, 135 and end panels 131, 139 downwardly at the respective fold lines 129, 133, 137, 141 in the direction of respective arrows A1, A2, A3, A4 relative to the central panel 125. As shown, the central panel 125 forms an uppermost panel of the cover 105. In one embodiment, the side panels 127, 135 and end panels 131, 139 could be folded upwardly relative to the central panel 125 such that the central panel 125 forms a lowermost panel of the cover 105 without departing from the disclosure. The attachment flaps 183, 185, 191, 193 can be overlapped, e.g., underlapped, in at least partial face-to-face contact with the respective corner flaps 143, 145, 159, 161 and secured thereto, for example, with an adhesive such as glue, to form the corners 175, 177, 179, 181 of the cover 105. In such an arrangement, the cover 105 has a generally downwardly concave configuration and defines an interior cavity 239 (FIG. 6) therein.

Referring to FIGS. 1-3, the corners 175, 177, 179, 181 each have a generally oblique arrangement formed by the cooperation, e.g., intersection and/or abutting arrangement, of the respective corner panels 167 and 143, 145 and 151, 161 and 153, and 159 and 169. In particular, the first corner 175 is disposed between the first side panel 127 and the first end panel 139 and comprises the first corner flap 143 cooperating with the second corner flap 167, the second corner 177 is disposed between the first side panel 127 and the second end panel 131 and comprises the third corner flap 145 cooperating with the fourth corner flap 151, the third corner 179 is disposed between the second end panel 131 and the second side panel 135 and comprises the fifth corner flap 161 cooperating with the sixth corner flap 153, and the fourth corner 181 is disposed between the second side panel 135 and the first end panel 139 and comprises the seventh corner flap 159 cooperating with the eighth corner flap 169. As shown, each respective corner flap 143, 145, 161, 159 is obliquely disposed relative to a respective adjacent corner flap 167, 151, 153. 169 such that the corners 175, 177, 179, 181 are conformed to portions of the container P as described above.

Referring to FIGS. 1-5, following formation of the cover 105, the cover 105 can be lowered onto or otherwise disposed on a suitable container, such as the container P, as shown. The container P can be at least partially disposed in the interior cavity 239 (FIG. 6) of the cover 105 such that the openings 199, 201, 203, 205 are in registration with a rim or flange or edge E of the container P. As shown, the interengagement of the cover 105 and the container P is such that one or more portions of the rim or edge E of the container P is received through a respective opening 199, 201, 203, 205 and protrudes from the interior cavity 239 outwardly through the respective openings 199, 201, 203, 205. The respective engagement edges 207, 209, 211, 214 of the openings 199, 201, 203, 205 frictionally engage the portions of the rim or edge E received in the openings 199, 201, 203, 205. In one embodiment, the cover 105 and the container P can be positioned relative to one another such that one or more of the engagement edges 207, 209, 211, 214 are biased against a portion of the container P that extends thereby. Such engagement of the cover 105 and the container P may be accompanied by one or more physical indicia, for example, a vibratory sensation or audible click. In this regard, the cover 105 is engaged with and secured to the container P, e.g., through interlocking, such that the cover 105 and container P resist disengagement other than through user intervention, as described further herein.

Figure 6:
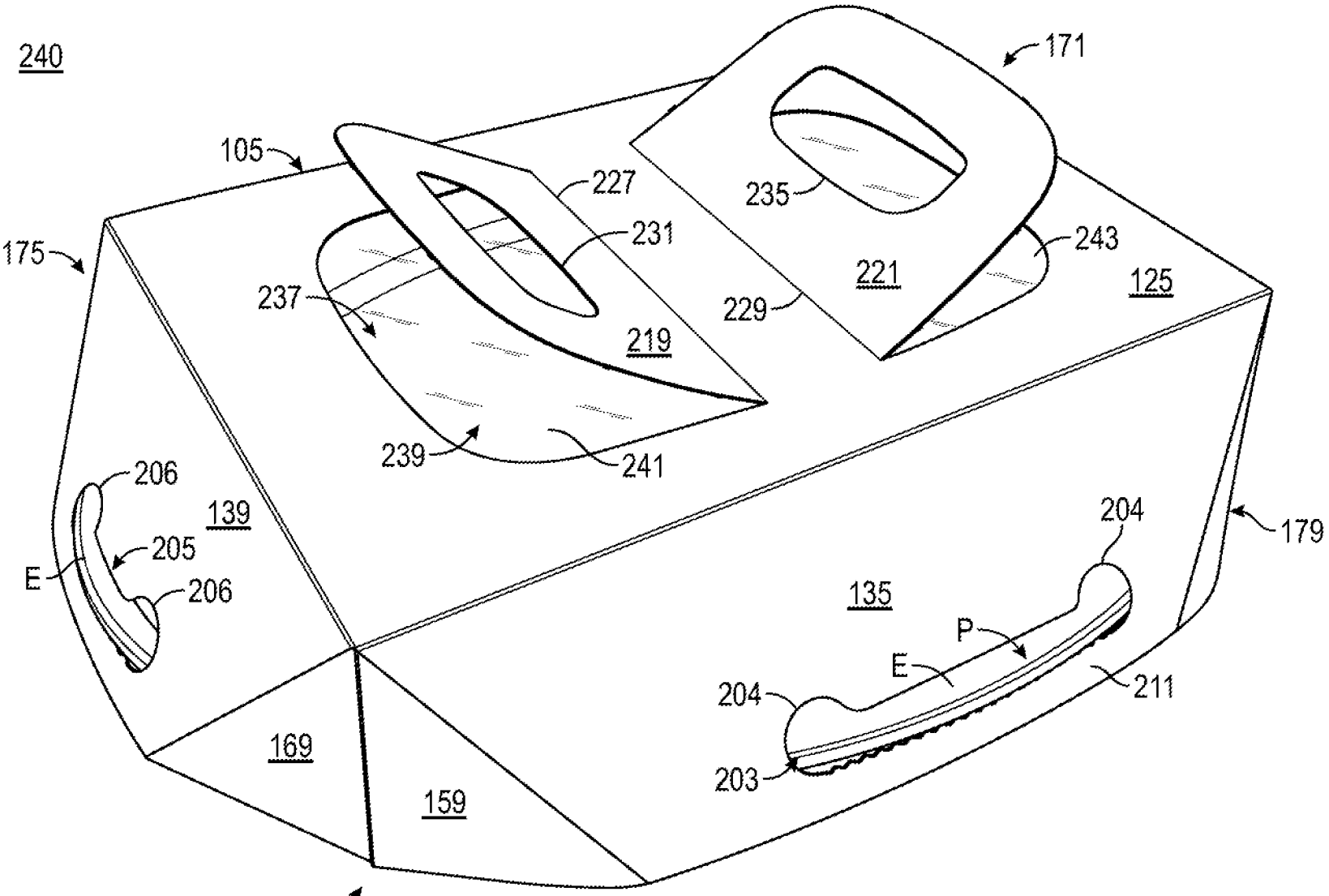
FIG. 6 is a first sequential perspective view of the package of FIG. 5 in use.

Referring additionally to FIG. 6, the handle 217 can be formed by separating the first handle flap 219 and the second handle flap 221 from the central panel 125 along the respective tear lines 223, 225 and lifting upwardly and pivoting the handle flaps 221, 225 upwardly about the respective fold lines 227, 229. The first handle flap 219 and the second handle flap 221 can be folded upwardly into proximity such that the respective handle openings 231, 235 are at least partially aligned for grasping the handle 217 by a user, tool, or other structure. In this regard, the handle 217 is foldably connected to the central panel 125 and can be used to engage and lift both the cover 105 and the container P such that the cover 105 acts to both cover a food item placed in the container and provide a carrying structure for the container P. Accordingly, the cover 105 and the container P can be provided together as a package 240 for covering and carrying one or more articles, for example, food or beverage items, supported on or in the container P. In this regard, a portion of the container P opposite the central panel 125 of the cover 105 forms a bottom of the package 240.

Upon raising of the handle flaps 219, 221 as shown, respective windows 241, 243 into the interior cavity 239 of the cover 105 are exposed, with the film 237 in at least partial face-to-face relation with a plane defined by the windows 241, 243. The film 237 can be transparent such that the interior cavity 239 and/or one or more portions of the underlying container P and/or articles such as food or beverage items stored therein are visible through the windows 241, 243. The film 237 can also maintain one or more conditions of an environment within the interior cavity 239 and/or the container P, for example, temperature, moisture content, aroma, and/or flavor. For example, the film 237 can provide an at least partial fluid barrier to minimize, inhibit, and/or prevent the passage of fluid such as air and/or vapor through the windows 241, 243 in the central panel 125. The film 237 may also provide a physical barrier to the instrusion of pests such as insects into the interior cavity 239 of the cover 105 and/or to prevent inadvertent passage of materials such as food or beverage items, for example, due to spillage, from the interior cavity 239 of the cover 205 to an exterior of the cover 105 and/or to an external environment. An at least partial seal surrounding the interior cavity 239 and formed by the substantially continuous surfaces of the container P, the panels 127, 131, 135, 139, and the film 237 can contribute to such maintenance of the environment within the interior cavity 239. In one embodiment, the cover 105 can be devoid of the film 237. In another embodiment, the windows 241, 243 could be omitted and the handle 217 and central panel 125 could be configured such that the central panel 125 is free from openings or windows when the handle 217 is activated, without departing from the disclosure.

When disengagement of the cover 105 from the container P is desired, the portions of the rim or edge E of the container P that protrude through the openings 199, 201, 203, 205 can be withdrawn into the interior cavity 239 of the cover 105, for example, through manipulation, e.g., bending, shifting, or flexion, of one or more portions of the container P and/or the panels 127, 131, 135, 139 of the cover 105. Such disengagement of the cover 105 from the container P can include lifting portions of the container P away from one or more of the engagement portions 207, 209, 211, 214. In one embodiment, the side panels 127, 135 and/or end panels 131, 139 can be flexed outwardly to allow the cover 105 to be separated from and lifted away from the container P, for example, to access one or more food or beverage items disposed thereon or therein.

In this regard, the cover 105 is provided for a container, such as container P, so that the cover 105 at least partially overlies, e.g., covers, the container and additionally provides a handle or other carrying feature by which both the cover 105 and the container can be lifted and/or carried. Such properties of the cover 105 can obviate the need for container accessories such as a polymeric cover for the container and/or a polymeric bag within which the container P can be carried. Eliminating the need for such accessories allows the cover 105 to be selected from desired materials (e.g., paperboard) so that savings can be achieved with respect to materials from which container accessories are formed, for example, polymeric materials such as plastic. Further, a paperboard cover 105 can be viewed as more environmentally-friendly in that the paperboard used for the cover can be more easily recycled than polymeric materials. However, it will be understood that the aforementioned accessories can be provided with the cover 105/package 240 without departing from the disclosure.

Figure 8:
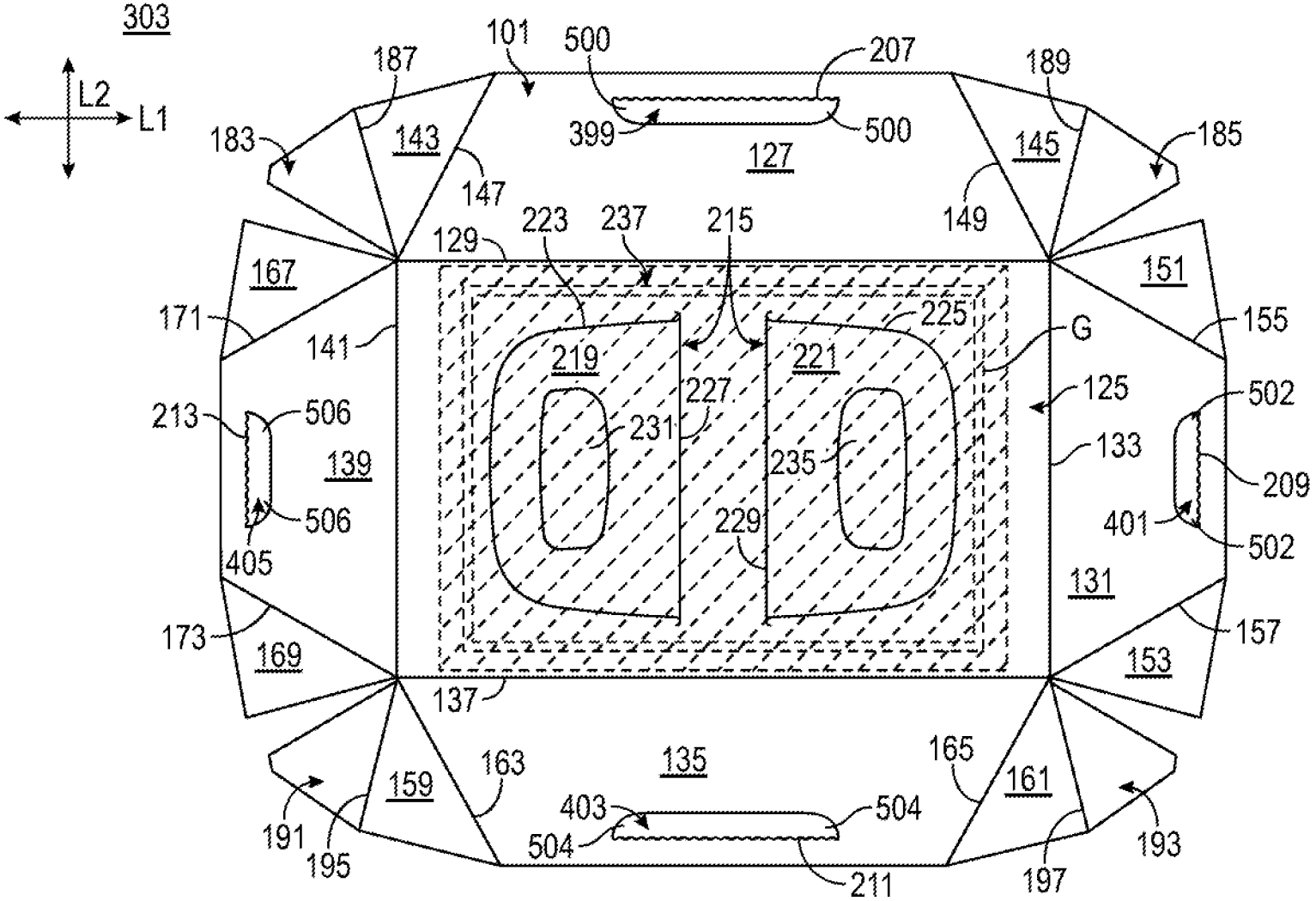
FIG. 8 is a plan view of an outer surface of a blank for forming a cover according to a second exemplary embodiment of the disclosure.

Referring additionally to FIG. 8, a blank for forming a cover according to a second exemplary embodiment of the disclosure is generally designated 303. The blank 303 includes one or more features that are similar to features of the blank 103 (FIG. 1) according to the first exemplary embodiment of the disclosure, and like or similar features are designated with like or similar reference numbers. The blank 303 can include the attachment flaps 183, 185, 193, 191 foldably connected to the respective corner panels 143, 145, 161, 159 at the respective oblique fold lines 187, 189, 197, 195. As shown, the blank 303 includes openings 399, 401, 403, 405 in the respective panels 131, 135, 139, 137 that are similar to the openings 199, 201, 203, 205 of the first exemplary embodiment. The openings 399, 401, 403, 405 include the respective engagement edges 207, 209, 211, 213, but include differently-configured end portions than the openings 199, 201, 203, 205. For example, the openings 399, 401, 403, 405 can include ends 500, 502, 404, 406 that are curved so as to at least partially taper. One or more of the openings 399, 401, 403, 405 can have a different configuration without departing from the disclosure, for example, to accommodate a container of a desired size or shape therethrough. The blank 303 can form a cover and a package similar to the cover 105 (FIG. 2) and the package 240 (FIG. 5) of the first exemplary embodiment, and that include the openings 399, 401, 403, 405. It will be understood that the blank 303 can have a different configuration without departing from the disclosure.

In general, the blank may be constructed from paperboard having a caliper so that it is heavier and more rigid than ordinary paper. The blank can also be constructed of other materials, such as cardboard, or any other material having properties suitable for enabling the cover to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A cover attached to a container, the cover comprising:
a plurality of panels extending at least partially around an interior of the cover, the plurality of panels comprising a central panel, a first side panel foldably connected to the central panel, a second side panel foldably connected to the central panel, a first end panel foldably connected to the central panel, and a second end panel foldably connected to the central panel;
the first side panel comprises a first opening, the second side panel comprises a second opening, the first end panel comprises a third opening, and the second end panel comprises a fourth opening, each opening configured and positioned to receive a portion of the container, each opening comprises an engagement edge engaging the container, each opening receiving a respective portion of the container therethrough from the interior of the cover; and
a handle foldably connected to the central panel.

2. The cover attached to a container of claim 1, wherein the engagement edge comprises a series of joined peaks.

3. The cover attached to a container of claim 2, wherein each opening has a generally elongate configuration and includes at least one enlarged end.

4. The cover attached to a container of claim 3, wherein the at least one enlarged end has a generally circular configuration.

5. The cover attached to a container of claim 1, wherein the handle comprises a first handle flap and a second handle flap each foldably connected to the central panel.

6. The cover attached to a container of claim 5, wherein the first handle flap and the second handle flap are raised upwardly from the central panel to expose a pair of windows in the central panel.

7. The cover attached to a container of claim 6, further comprising a film in at least partial face-to-face relation with a plane defined by the pair of windows.

8. The cover attached to a container of claim 1, wherein a first corner is disposed between the first side panel and the first end panel, a second corner is disposed between the first side panel and the second end panel, a third corner is disposed between the second end panel and the second side panel, and a fourth corner is disposed between the second side panel and the first end panel.

9. The cover attached to a container of claim 8, wherein the first corner comprises a first corner flap foldably connected to the first side panel and cooperating with a second corner flap foldably connected to the first end panel, the second corner comprises a third corner flap foldably connected to the first side panel and cooperating with a fourth corner flap foldably connected to the second end panel, the third corner comprises a fifth corner flap foldably connected to the second side panel and cooperating with a sixth corner flap foldably connected to the second end panel, and the fourth corner comprises a seventh corner flap foldably connected to the second side panel and cooperating with an eighth corner flap foldably connected to the first end panel.

10. The cover attached to a container of claim 9, wherein each corner flap is obliquely disposed relative to an adjacent corner flap such that each corner conforms to a portion of the container.

11. A method of forming and positioning a cover for a container, the method comprising:

obtaining a blank comprising a plurality of panels, the plurality of panels comprising a central panel, a first side panel foldably connected to the central panel and comprising a first opening, a second side panel foldably connected to the central panel and comprising a second opening, a first end panel foldably connected to the central panel and comprising a third opening, and a second end panel foldably connected to the central panel and comprising a fourth opening, and at least one handle flap foldably connected to the central panel, each opening comprises an engagement edge;

folding the plurality of panels at least partially around an interior of the cover; and engaging the cover with the container such that each opening receives a respective portion of the container therethrough from the interior of the cover.

12. The method of claim 11, wherein the engagement edge comprises a series of joined peaks.

13. The method of claim 12, wherein each opening has a generally elongate configuration and includes at least one enlarged end.

14. The method of claim 13, wherein the at least one enlarged end has a generally circular configuration.

15. The method of claim 11, wherein the at least one handle flap is a first handle flap and the blank further comprises a second handle flap, the first handle flap and the second handle flap form a handle foldably connected to the central panel.

16. The method of claim 15, wherein the first handle flap and the second handle flap are raised upwardly from the central panel to expose a pair of windows in the central panel.

17. The method of claim 16, further comprising a film in at least partial face-to-face relation with a plane defined by the pair of windows.

18. The method of claim 11, wherein a first corner is disposed between the first side panel and the first end panel, a second corner is disposed between the first side panel and the second end panel, a third corner is disposed between the second end panel and the second side panel, and a fourth corner is disposed between the second side panel and the first end panel.

19. The method of claim 18, wherein the first corner comprises a first corner flap foldably connected to the first side panel and cooperating with a second corner flap foldably connected to the first end panel, the second corner comprises a third corner flap foldably connected to the first side panel and cooperating with a fourth corner flap foldably connected to the second end panel, the third corner comprises a fifth corner flap foldably connected to the second side panel and cooperating with a sixth corner flap foldably connected to the second end panel, and the fourth corner comprises a seventh corner flap foldably connected to the second side panel and cooperating with an eighth corner flap foldably connected to the first end panel.

20. The method of claim 19, wherein each corner flap is obliquely disposed relative to an adjacent corner flap such that each corner conforms to a portion of the container.

21. A package, the package comprising:

a cover engaged with a container, the cover comprising:

a plurality of panels extending at least partially around an interior of the cover, the plurality of panels comprising a central panel, a first side panel foldably connected to the central panel, a second side panel foldably connected to the central panel, a first end panel foldably connected to the central panel, and a second end panel foldably connected to the central panel;

the first side panel comprises a first opening, the second side panel comprises a second opening, the first end panel comprises a third opening, and the second end panel comprises a fourth opening, each opening comprising an engagement edge engaging the container, a respective portion of the container extending through each opening from the interior of the cover; and a handle foldably connected to the central panel.

22. The package of claim 21, wherein the engagement edge comprises a series of joined peaks.

23. The package of claim 21, wherein each opening has a generally elongate configuration and includes at least one enlarged end.

24. The package of claim 23, wherein the at least one enlarged end has a generally circular configuration.

25. The package of claim 21, wherein the handle comprises a first handle flap and a second handle flap each foldably connected to the central panel.

26. The package of claim 25, wherein the first handle flap and the second handle flap are raised upwardly from the central panel to expose a pair of windows in the central panel.

27. The package of claim 26, further comprising a film in at least partial face-to-face relation with a plane defined by the pair of windows.

28. The package of claim 21, wherein a first corner is disposed between the first side panel and the first end panel, a second corner is disposed between the first side panel and the second end panel, a third corner is disposed between the second end panel and the second side panel, and a fourth corner is disposed between the second side panel and the first end panel.

29. The package of claim 28, wherein the first corner comprises a first corner flap foldably connected to the first side panel and cooperating with a second corner flap foldably connected to the first end panel, the second corner comprises a third corner flap foldably connected to the first side panel and cooperating with a fourth corner flap foldably connected to the second end panel, the third corner comprises a fifth corner flap foldably connected to the second side panel and cooperating with a sixth corner flap foldably connected to the second end panel, and the fourth corner comprises a seventh corner flap foldably connected to the second side panel and cooperating with an eighth corner flap foldably connected to the first end panel.

30. The package of claim 29, wherein each corner flap is obliquely disposed relative to an adjacent corner flap such that each corner conforms to a portion of the container.

* * * * *